US010849421B2

(12) United States Patent
Clos

(10) Patent No.: US 10,849,421 B2
(45) Date of Patent: Dec. 1, 2020

(54) BRUSH

(71) Applicant: M+C Schiffer GmbH, Neustadt/Wied (DE)

(72) Inventor: Thomas Clos, Cologne (DE)

(73) Assignee: M+C Schiffer GmbH

( * ) Notice: Subject to any disclaimer, the term of this patent is extended or adjusted under 35 U.S.C. 154(b) by 67 days.

(21) Appl. No.: 16/312,327

(22) PCT Filed: Jun. 29, 2017

(86) PCT No.: PCT/EP2017/066079
§ 371 (c)(1),
(2) Date: Dec. 21, 2018

(87) PCT Pub. No.: WO2018/002192
PCT Pub. Date: Jan. 4, 2018

(65) Prior Publication Data

US 2019/0191862 A1 Jun. 27, 2019

(30) Foreign Application Priority Data

Jun. 30, 2016 (EP) ..... 16177235

(51) Int. Cl.
*A46B 13/00* (2006.01)
*A46B 5/00* (2006.01)
*A46B 13/02* (2006.01)

(52) U.S. Cl.
CPC ..... *A46B 13/008* (2013.01); *A46B 5/0012* (2013.01); *A46B 13/02* (2013.01); *A46B 2200/102* (2013.01)

(58) Field of Classification Search
CPC ... A61C 17/26; A61C 17/3436; A61C 17/222; A46B 13/02; A46B 13/008; A46B 5/0012; A46B 2200/102; A46B 2200/1066; A46B 13/00; A46B 13/0026; A46B 5/0008; A46B 5/0016; A46B 5/0025; A46B 5/0037; A46B 5/0041; A46B 5/0045; A46B 5/0062; A46B 2200/00; A46B 15/00; A46B 5/00
See application file for complete search history.

(56) References Cited

U.S. PATENT DOCUMENTS

| | | | | |
|---|---|---|---|---|
| 6,032,313 | A | 3/2000 | Tsang | |
| 9,386,843 | B2 * | 7/2016 | Grez | A46B 13/008 |
| 2004/0117934 | A1 | 6/2004 | Pfenniger et al. | |
| 2006/0047234 | A1 * | 3/2006 | Glucksman | A61B 17/54 601/87 |
| 2006/0135891 | A1 | 6/2006 | Jordan et al. | |
| 2013/0007969 | A1 * | 1/2013 | Driesen | A46B 9/00 15/28 |

(Continued)

FOREIGN PATENT DOCUMENTS

| | | | |
|---|---|---|---|
| DE | 10259723 | A1 | 7/2004 |
| EP | 1603429 | B1 | 8/2007 |

(Continued)

*Primary Examiner* — Robert J Scruggs
(74) *Attorney, Agent, or Firm* — The Webb Law Firm

(57) ABSTRACT

The present invention relates to an improved brush, in particular a brush for facial care, with several carriers including cleaning elements and each connected to a shaft, and a casing that pivotably mounts said carriers and that supports a common drive shaft for said carriers and which is drive-coupled to said shafts.

10 Claims, 2 Drawing Sheets

(56) References Cited

U.S. PATENT DOCUMENTS

| | | | | |
|---|---|---|---|---|
| 2015/0190299 | A1 | 7/2015 | Jurna et al. | |
| 2015/0202114 | A1 | 7/2015 | Pardoel et al. | |
| 2016/0045081 | A1* | 2/2016 | Kern ..... | A46B 13/02<br>15/22.4 |

FOREIGN PATENT DOCUMENTS

| | | | |
|---|---|---|---|
| JP | 03280911 | * | 12/1991 |
| JP | H03-280911 | A | 12/1991 |
| WO | 03096860 | A1 | 11/2003 |
| WO | 2014009177 | A1 | 1/2014 |
| WO | 2014024084 | A1 | 2/2014 |
| WO | 2016025702 | A1 | 2/2016 |

* cited by examiner

BRUSH

CROSS-REFERENCE TO RELATED APPLICATIONS

This application is the United States national phase of International Application No. PCT/EP2017/066079 filed Jun. 29, 2017, and claims priority to European Patent Application No. 16177235.5 filed Jun. 30, 2016, the disclosures of each of which are hereby incorporated by reference in their entireties.

BACKGROUND OF THE INVENTION

Field of the Invention

The present invention relates generally to a brush, in particular, to a brush for personal care, especially for facial care.

Description of Related Art

Such a brush is known from U.S. Pat. No. 6,032,313 A.

U.S. Pat. No. 6,032,313 A describes a brush with a rotating head, which is driven by a motor using a central drive shaft. The central drive shaft is there supported by locking arms in a casing and connected to a carrier comprising several or multiple cleaning elements.

Prior art also knows a brush especially for facial care. It comprises a handle which accommodates a drive in itself, the drive shaft of which is connected to a rotatably mounted carrier holding a plurality of bristle bundles, so that a scrubbing or massaging motion is performed upon rotation of the carrier and pressing the bristle bundles with their cleaning side ends against the surface of the skin (e.g., WO 2014/024084 A1 or WO 2014/009177 A1) or WO 2003/096860.

SUMMARY OF THE INVENTION

The present invention is based on the object of providing an improved brush, in particular for facial care.

To satisfy this object, a brush according to the present invention is provided. The brush with a carrier comprises multiple cleaning elements and a casing supporting a drive shaft for said carrier. The brush comprises a plurality of carriers with multiple cleaning elements which are each connected to a shaft. The casing pivotably mounts the shafts, and a common drive shaft is provided for said carriers and is drive-coupled to the shafts.

This brush has multiple carriers comprising cleaning elements. For example, bristle bundles comprising bristle filaments or cleaning elements made of soft elastic plastic material, such as TPE, are understood to be cleaning elements within this meaning. Such cleaning elements can be provided individually or in combination with each other on the carrier. Each carrier typically has multiple such cleaning elements which are preferably provided substantially over the entire surface of the carrier and project through the latter's surface. The cleaning elements can be connected to this carrier by methods known per se for attaching cleaning elements to a carrier, for example, by using anchors of without anchors (cf., for example, DE 102 59 723 A1).

The carrier, preferably each carrier, is pivotably mounted on a casing. For this purpose, the respective carriers each have a shaft which is preferably formed integrally on the carrier and about the axis of which the carrier pivots. Strictly speaking, pivoting is understood to be a rotation about the respective axis by less than 360°. Stops can then be provided which prevent a full rotation motion. However, the carrier can also rotate together with the axis, where such a rotating motion is considered to be pivotable within the meaning of claim 1. The feature means, in particular, that the carrier is movably mounted for a rotational motion about the axis formed by the shaft. The pivotability or rotatability of the carrier results from the fact that the carriers are typically connected in a rotationally fixed manner to the shaft respectively associated with the carrier, where the shaft is mounted pivotably or rotatably, respectively, in the casing. The carrier is rotated or pivoted along with the rotating shaft. The carrier is typically made of plastic material, generally a hard component such as PP, ABS, PA, PBT or PE. For manufacturing the carrier and for connecting the carrier to the cleaning elements, it is possible to use any technology known, in particular, that from the field of toothbrushes. The same applies for the materials used there for the carrier and/or the cleaning elements. The casing is likewise preferably made of plastic material. According to the invention, the casing supports a common drive shaft which is provided for the carriers and which is drive-coupled to the shafts of the carriers. The coupling is there typically effected using gears, preferably using a gearing which can have a lower or a higher gear ratio in order to change the rotational speed of a drive to the drive shaft relative to the rotational speed of the shaft of the carriers. The casing can at the same time also be a holder or form the latter, where the holder can comprise the drive to the drive shaft in a manner known per se. This drive can be battery operated. In this embodiment, the batteries are provided within the holder. Alternatively, the drive can be mains-connected and a cable be led out of the casing with which electric power can be delivered to the drive.

The drive can be configured such that it imparts a smooth rotational motion upon the drive shaft and therewith upon the carriers. Alternatively, the drive can also be operated in an oscillating manner with a reversing rotational motion or operated vibrating at a high-frequency. In particular with the latter configuration, the carriers are preferably pivoted only by an angular range and not rotated.

The solution according to the invention can be operated with the same cleaning-active surface as the prior art brush, in particular to massage and/or to clean the facial area. By distributing the cleaning elements to different carriers, however, the cleaning-active surface of the cleaning elements can better adapt to the contour of the surface to be cleaned. The sensitive facial skin is then less irritated, whereby redness in the face due to the cleaning with the brush according to the invention can be reduced or avoided altogether.

The shafts of the carriers preferably extend substantially parallel to one another and parallel to the axial direction of the drive shaft. The drive shaft and the shafts of the carriers are commonly coupled together by way of a planetary gear, whereby the rotational motion of the central and common drive shaft can be transmitted to all carriers in a simple manner. Two to six carriers are preferably provided and arranged eccentrically relative to the drive shaft.

DESCRIPTION OF THE INVENTION

Figure 2:
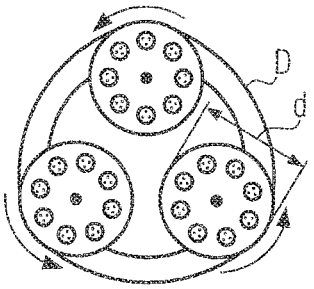
FIG. 2 is a top view onto the embodiment shown in FIG. 1.

According to a further preferred embodiment of the present invention, the carriers are mounted elastically relative to the casing, and in such a way that each carrier is pivotable relative to an axial direction of the shaft. Accordingly, the plate-shaped carrier can pivot depending on the external load actually acting upon the carrier, so that the cleaning elements provided on the carrier abut as completely as possible against the surface to be over-swept. The ends of the shafts which mesh with the drive shaft remain in engagement with the drive shaft. The shaft can then be curved during the drive operation due to its elasticity. The carrier typically projecting over the shaft accordingly has an axis of rotation which is pivoted relative to the axis of rotation of the drive-side end of the shaft. The pivot angle can be at most 30°, if necessary, also only at most 20°. The shaft of the carrier can also be supported in an elastic sleeve which allows certain movability of the shaft mounted in the casing relative to the casing and, accordingly, the desired pivot motion.

Preferably, a bearing casing is provided for each shaft and accommodates a gear associated with the shaft and rotatably mounts the shaft. Further preferably, each bearing casing is pivotable via a bearing shaft about a wobble axis which extends at a right angle to the axial direction of the associated shaft. According to this preferred embodiment, the bearing casing can perform a wobble motion about the wobble axis, which causes the shaft mounted in the bearing casing to pivot. The wobble axis is preferably fixed, i.e. not coupled to the rotational motion of the shaft. As a result, the orientation of the wobble axis of each bearing casing can be optimally defined relative to the number of existing carriers or bearing casings, respectively, in order to obtain the best possible adaptation to the facial contours when the brush is applied. Particularly preferably, each gear associated with a shaft comprises a toothing which is convex in the axial direction of the shaft and which meshes with the toothing of a cylindrical planetary gear of the planetary gearing. It can thereby be ensured that even with a wobble motion of the bearing casing, the gear associated with the shaft remains engaged with the gear of the planetary gearing and that the drive coupling does not break off.

At the brush, the carriers preferably have a circular base area and are formed to be plate-shaped. The diameter of the carriers is between 10 and 25 mm. The cleaning elements provided on the carrier are preferably bristle bundles formed by bristle filaments having a filament thickness of 2 to 8 mils.

Figure 3:
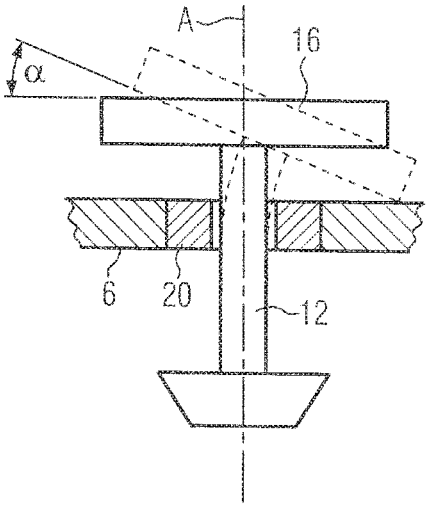
FIG. 3 is an enlarged detail view of detail III according to FIG. 1.
Figure 1:
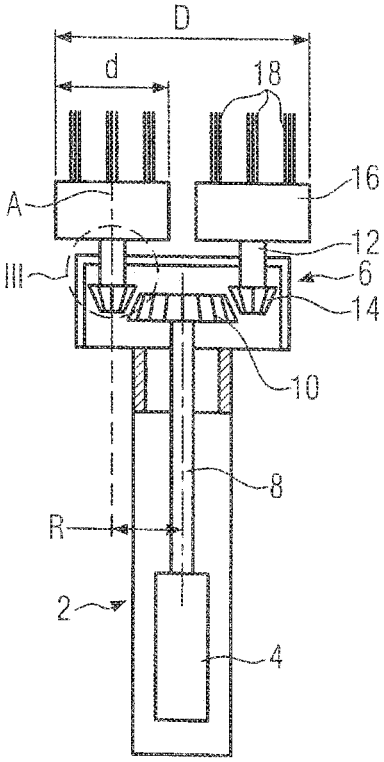
FIG. 1 is a partially sectioned side view of an embodiment of the brush according to the invention.
Figure 4:
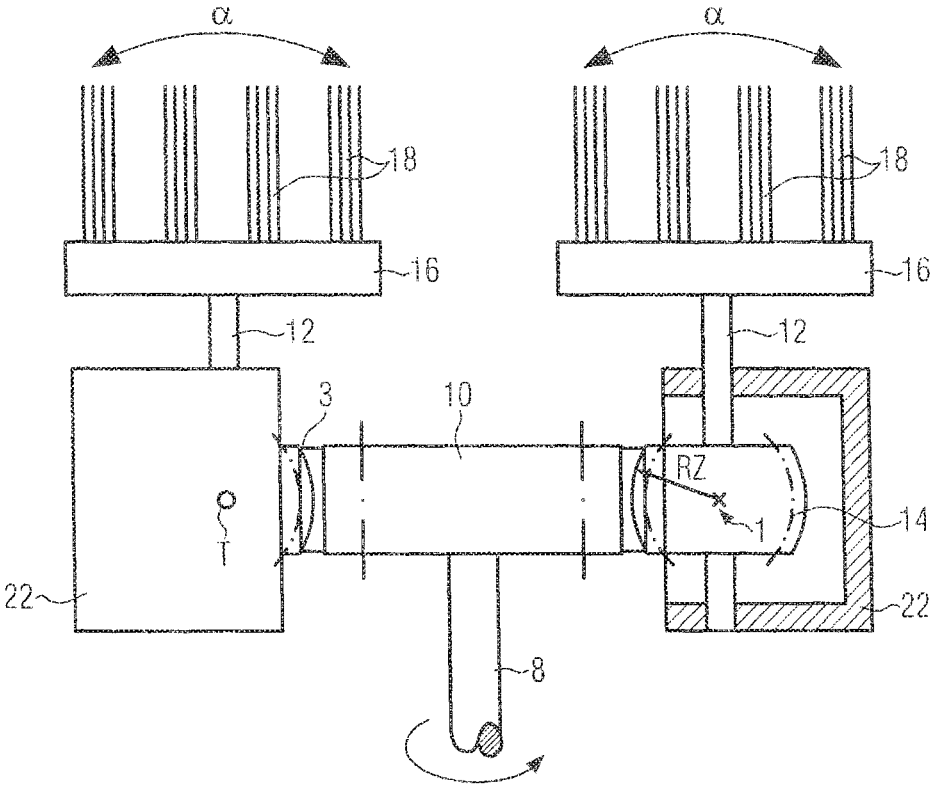
FIG. 4 is a schematic view of a gearing for a second embodiment modified over the first embodiment.
Figure 5:
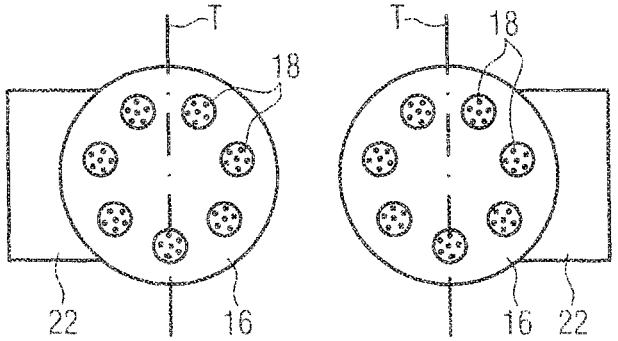
FIG. 5 is a top view onto the second embodiment according to FIG. 4.

Further details and advantages of the present invention shall become apparent from the following description of two embodiments in combination with the drawing, in which:

FIG. 1 is a partially sectioned side view of an embodiment of the brush according to the invention;

FIG. 2 is a top view onto the embodiment shown in FIG. 1;

FIG. 3 is an enlarged detail view of detail III according to FIG. 1;

FIG. 4 is a schematic view of a gearing for a second embodiment modified over the first embodiment and FIG. 5 is a top view onto the second embodiment according to FIG. 4.

In the drawing, FIG. 1 shows a longitudinal sectional view of an embodiment with a holder 2 which is adapted and configured such that it can be grasped by the hand of a user. The holder 2 is configured as a hollow body and accommodates batteries or an accumulator and a drive drawn in a stylized manner in the form of an electric motor 4. The batteries or the accumulator(s) are typically exchangeable, for which purpose a removable cover is provided on the holder 2, typically at the grip end of the holder 2. At the oppositely disposed end, the holder 2 forms a gearing casing 6. This gearing casing 6 receives the drive-side end of a drive shaft 8 which is provided with a planetary gear 10 as a drive gear. The other end of the drive shaft 8 is connected to the drive 4. The gearing casing 6 further accommodates the drive-side ends of the shafts 12 which are provided with the gears 14 which mesh with the planetary gear 10. The planetary gear 10 and the gears 14 are toothed bevel gears which are mounted in a fixed manner but rotatably on the casing 2, 6. The shafts 12 at their ends facing away from the gears 14 each carry a plate-shaped carrier 16 with a circular cross-sectional shape which is presently formed having a diameter d of 20 mm. Each carrier 16 carries a plurality of bristle bundles 18 as cleaning elements. The bristle bundles 18 extend parallel to the longitudinal extension direction of the shaft 12 or the drive shaft 8, respectively. The shafts 12 are supported against the gearing casing 6 by way of an elastic bearing bush 20 illustrated in FIG. 3. The bearing bush 20 can be made, for example, of soft elastic material, such as TPE, and connected to the material of the gearing casing 6, for example, be connected in a positive-fit or positive substance-fit manner thereto. In particular an adhesive connection is considerable as a connection in a positive substance-fit manner.

FIG. 1 defines several parameters. Drawn in as R is the radial distance between the drive shaft 8 and the shaft 12. This distance R in the present invention is preferably between 15 mm and 35 mm. d is the aforementioned diameter of the plate-shaped carrier 16. D is the outer circumference formed by a circular envelope surface, the center of which coincides with the axis of rotation of the drive shaft 8 and which is tangentially applied to the outer circumferential surface of the individual carriers 16. This diameter D is between 30 mm and 80 mm.

Due to the meshing connection between the gears 14 and the planetary gear 10, a rotational motion of the carriers 16 arises during operation of the drive 4. This can be a smoothly rotating or an oscillating motion. The carriers 16 are formed together with the shafts 12 and the gear 14 as integrated injection-molded members. This integrated injection-molded member can accommodate the cleaning elements 18 and be attached thereto. Alternatively, a platelet carrying the cleaning elements can first be provided with the cleaning elements and then connected to the injection-molded member consisting of the carrier 16, the shaft 12 and the gear 14. The diameter and/or the material nature of at least the shaft 12 can there be such that the carrier 16 can be pivoted relative to an axis direction indicated by A in FIG. 1. In FIG. 1, the surface of the carrier 16 extends at a right angle to this axial direction A. This initial position is drawn in using solid lines in FIG. 3. Shown by the dashed lines is an orientation of the carrier 16 pivoted by 30° relative thereto, which is made possible by the elasticity of the shaft 12 and/or the elasticity of the bearing bush 20. Also in this inclined orientation, the shaft 12 is driven by way of the drive shaft 8, so that the plate-shaped carrier 16 with the cleaning elements 18 is rotated. The pivot angle of the carrier 16 relative to the initial position is indicated by "α".

In the second embodiment shown in FIGS. 4 and 5, same components are designated by the same reference numerals. The gears 14 have a convex toothing in the axial direction which mesh with the toothing of a cylindrical planetary gear 10. The gears 14 are accommodated in a bearing casing 22 which rotatably supports the shaft 12 associated with the respective gear 14. A bearing casing 22 is provided for each of the shafts 12 with the associated gear 14. Each bearing casing 22 is mounted via a bearing shaft 24 pivotable relative to a gearing casing, presently not shown. The bearing casing 22 is pivotable via a bearing shaft 24 about a wobble axis T which extends at a right angle to the axial direction A of the associated shaft 12. Where the wobble axis T intersects the respective shaft 12 at the center. Due to the convexity of the toothing of the gears 14, which are curved having a radius RZ in the axial direction, the gears 14 remain in engagement with the planetary gear 10 at angle α during this wobble motion. The gearing casing 6 can comprise stops which interact with the bearing casing 22 to limit the wobble motion within a predetermined wobble angle α.

The carrier 16 can comprise various functional areas. The bristle bundles can there be attached to bristle carrier elements made of a hard plastic component such as PP or ABS. These hard bristle carrier elements can be embedded in a soft elastic mass and connected therewith, so that the individual bristle bundles can pivot on the attachment side relative to a base, as can be gathered from EP 1 603 429 B1. The bristle carrier elements can then "float" freely in the thermoplastic elastomer or else be connected to one another by way of relatively thin webs. This configuration can be held within a ring formed from a hard component that forms the outer circumferential surface of the carrier 16. In addition to bristle bundles, also cleaning elements made of thermoplastic elastomer can be attached to the carrier. These cleaning elements can extend substantially parallel to the direction of extension of the bristle bundles. Thermoplastic elastomer can also be applied to the circumferential edge of a hard component of the carrier 16. This thermoplastic elastomer constitutes a shock protection. The outer circumferential edge of the carrier 16 can also have cleaning elements, for example, made of TPE. These cleaning elements can be arranged in the form of nubs or ribs on the outer circumferential surface of the carrier 16.

LIST OF REFERENCE NUMERALS

2 holder
4 drive
6 gearing casing
8 drive shaft
10 planetary gear
12 shaft
14 gear
16 carrier
18 bristle bundle
20 bearing bush
22 bearing casing
24 bearing shaft
A axial direction
R spatial distance between drive shaft 8 and shaft 12
RZ radius of curvature of gear 14
T wobble axis
D outer diameter brush
d outer diameter carrier
α pivot angle

The invention claimed is:

1. A brush comprising:

a plurality of carriers, each of the plurality of carriers comprising multiple cleaning elements and being connected to a respective shaft;

a casing pivotably mounting the shafts of the plurality of carriers; and a drive shaft for the plurality of carriers, the drive shaft being drive-coupled to each of the shafts of the plurality of carriers, wherein a bearing casing is provided for each of the shafts of the plurality of carriers, the bearing casing receiving a gear associated with the respective shaft and pivotably mounting the respective shaft.

2. The brush according to claim 1, wherein said shafts of said plurality of carriers each extend in parallel to one another.

3. The brush according to claim 1, wherein said drive shaft and said shafts of said plurality of carriers are drive-coupled to each other by way of a planetary gearing.

4. The brush according to claim 1, wherein two to six carriers are provided.

5. The brush according to claim 1, wherein each of the plurality of carriers is mounted to the casing by an elastic element, so that each of the plurality of carriers is pivotable relative to an axial direction of the respective shaft of the carrier.

6. The brush according to claim 1, wherein each of the plurality of carriers is pivotable relative to an axial direction of the respective shaft by no more than 30°.

7. The brush according to claim 1, wherein each of the plurality of carriers has a circular base area with a diameter of between 10 mm and 25 mm.

8. The brush according to claim 1, wherein each of the plurality of carriers carries at least one bristle bundle, said at least one bristle bundle being formed by bristle filaments having a filament thickness of 2-8 mils.

9. The brush according to claim 1, wherein each bearing casing is pivotable via a bearing shaft about a wobble axis which extends at a right angle to the axial direction of the respective shaft.

10. The brush according to claim 9, wherein the gear associated with the respective shaft of each of the plurality of carriers comprises a toothing that is convex in an axial direction of the respective shaft and meshes with toothing of a cylindrical planetary gear.

* * * * *